US005148572A

United States Patent [19]

Wells et al.

[11] Patent Number: 5,148,572

[45] Date of Patent: Sep. 22, 1992

[54] VIDEO GAME CONSOLE AND CARTRIDGE CLEANING KIT

[76] Inventors: James M. Wells, 1164 N. Oakwood Ave., Rialto, Calif. 92376; Gary L. Sigritz, 2960 Florine Ct., Riverside, Calif. 92509

[21] Appl. No.: 453,983

[22] Filed: Dec. 20, 1989

[51] Int. Cl.[5] ..... B08B 11/00

[52] U.S. Cl. ..... 15/118; 15/104.94; 15/209 R; 15/210 R

[58] Field of Search ..... 15/114, 118, 209 R, 15/210 R, 210 A, 214, 244.1, 104.94, 231, 208, 218, 218.1, 220 R, 104 S, 232; 604/1

[56] References Cited

U.S. PATENT DOCUMENTS

| | | | |
|---|---|---|---|
| 126,945 | 5/1872 | Finn | 15/118 X |
| 509,867 | 12/1893 | Brady . | |
| 521,223 | 6/1894 | Seter . | |
| 885,276 | 4/1908 | McDonald | 15/209 R |
| 1,151,274 | 8/1915 | Kaisling . | |
| 1,710,308 | 4/1929 | Grifalconi . | |
| 2,270,298 | 1/1942 | Hight | 15/118 X |
| 2,411,430 | 11/1946 | Hudson | 15/231 X |
| 2,471,236 | 5/1949 | Parker . | |
| 2,503,299 | 4/1950 | Rodriquez . | |
| 2,510,490 | 6/1950 | Ager | 604/1 |
| 2,705,009 | 3/1955 | Plantinga et al. | 604/1 |
| 2,734,320 | 2/1956 | Hoye . | |
| 3,099,855 | 8/1963 | Nash | 15/231 |
| 3,164,853 | 1/1965 | Peeler | 15/244.1 X |
| 3,187,362 | 6/1965 | Garrett . | |
| 3,321,796 | 5/1967 | Lelicoff | 15/104.94 |
| 3,504,459 | 4/1970 | Spiteri . | |
| 3,705,436 | 12/1972 | Holliday | 15/118 X |
| 3,807,010 | 4/1974 | Semrad . | |
| 4,428,092 | 1/1984 | Lipari . | |
| 4,717,345 | 1/1988 | Gordon et al. . | |
| 4,733,678 | 3/1988 | Bolois . | |
| 4,767,398 | 8/1988 | Blasius, Jr. | 604/1 |
| 4,951,425 | 8/1990 | Naghi . | |
| 5,025,526 | 6/1991 | Ichitsubo et al. | 15/210 R |

FOREIGN PATENT DOCUMENTS

| | | | |
|---|---|---|---|
| 1472611 | 1/1967 | France | 15/210 R |
| 460724 | 2/1937 | United Kingdom | 15/210 R |

*Primary Examiner*—Edward L. Roberts

*Attorney, Agent, or Firm*—Knobbe, Martens, Olson & Bear

[57] ABSTRACT

A kit for cleaning the contacts on video game consoles and cartridges comprises a cleaning solution, a cleaning clip, a cleaning card and a pair of cleaning wands. The cleaning solution is applied to the contacts of the console or the cartridge using one end of the cleaning card to remove dirt and other low voltage build up. The contacts are then dried with the opposite end of the cleaning card. For areas of the contacts that are difficult to reach with the cleaning card, two cleaning wands are provided. One wand is used for cleaning and the other for drying. Each wand is an angled oblong member with a porous fabric attached on the operational end. Additionally, the cleaning clip is sized for attachment to the game cartridge and cleans the contacts in the console. After the clip is attached, solution is placed on the clip and the cartridge is repeatedly removed and inserted from the console to brush the clip across the contacts and apply the cleaning solution.

11 Claims, 5 Drawing Sheets

VIDEO GAME CONSOLE AND CARTRIDGE CLEANING KIT

BACKGROUND OF THE INVENTION

The present invention relates to the field of video electronics. In particular, the present invention relates to video game systems used with television sets for entertainment in the home. More particularly, the present invention relates to a device and method for cleaning video game consoles and cartridges.

Video game systems used in the home are well known. Video game systems are basically simple computers that use joysticks, paddles and other devices for input, and the television screen for output. Information is output by sending signals which are displayed as pictures on the television screen. The picture displayed on the television screen is modified by the video game system depending on the program and the input received. A variety of games can be played by running different computer programs on the video game system. The computer programs are usually stored in game cartridges to make it easy to change the game being play by simply inserting a different game cartridge into the console of the video game system.

After a period of normal use, video game systems often experience problems presenting a clear and high quality picture on the television set. The problems typically encountered include: a screen that flashes on and off, a blank picture screen, a scrambled picture screen and other display problems. Additionally, systems may have difficulty responding to joysticks or other input devices after continued use. These display and input problems often result from poor electrical connection between the game cartridge and the console of the video game system. After extended use, the contacts which electrically interconnect the cartridge to the console become poor conducting paths because of "low voltage" build up on the contacts. Dirt and other foreign substances also collect on the contacts, and thus, prevent a good electrical connection between the game cartridge and the console. In addition, the build up of dirt and other debris promote corrosion or the contacts, the cartridge and the console.

It is known in the art to remove the low voltage build up and foreign matter from electrical contacts with cleaning solutions. However, these cleaning solutions typically include alcohol, benzene, thinner or other such solvents which are dangerous for children and also harmful to the video game console and cartridge. The manufacturers of video game systems recommend that these solvents not be used for cleaning to avoid damaging consoles and cartridges.

SUMMARY OF THE INVENTION

The present invention advantageously eliminates the problems of the prior art by providing a device and method for cleaning video game consoles and cartridges that does not use alcohol, benzene, thinner or other harmful solvents. In a preferred embodiment, the present invention is a kit for cleaning the contacts of a video game system comprising a cleaning clip, a cleaning card, cleaning wands and a special cleaning solution that does not contain any of the aforementioned harmful solvents. The contacts on a video game console may be cleaned using either the cleaning clip or a cleaning card. The cleaning clip is attached on a video game cartridge and then cleaning solution is applied on the cleaning clip. The cartridge with the clip attached is repeatedly inserted and removed from the console so that the cleaning clip brushes the contacts. The contacts on a video game cartridge may be cleaned in the same way using either the cleaning card or wand. Preferably, the special cleaning solution is placed on one end of the cleaning card. The card is then inserted into the video game cartridge to clean the contacts. After the solution is applied to the contacts using the cleaning card, the other end of the cleaning card is used to dry the contacts. If any of the contacts cannot be cleaned with the card or clip, then one wand is used to apply cleaning solution and another is used to dry the contacts. Thus, the present invention may clean any particular area of the contacts.

In one aspect, the present invention provides a kit for cleaning the contacts of a video game system that eliminates the danger of damaging the system by using a cleaning solution that does not contain alcohol, benzene, thinner or other such solvents.

In another aspect, the present invention provides a safe, simple and effective method to clean video game consoles and cartridges.

DESCRIPTION OF THE PREFERRED EMBODIMENT

Figure 7:
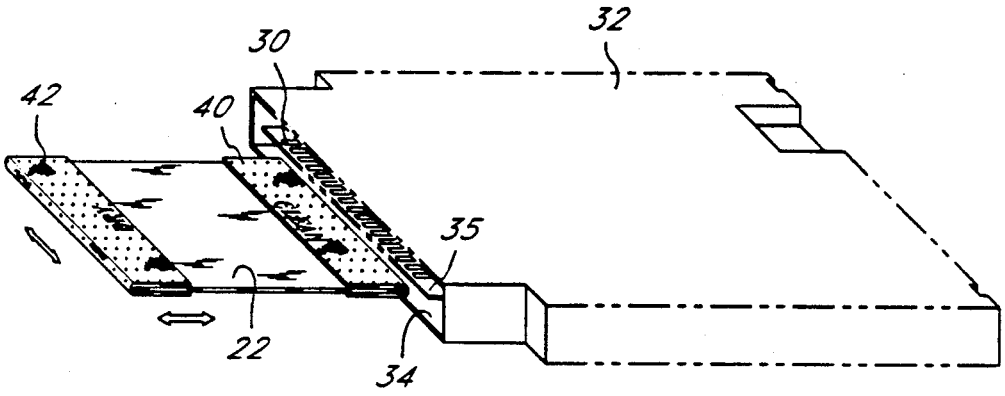
FIG. 7 is a perspective view of the preferred embodiment of the cleaning card of the present invention with a video game cartridge shown in phantom.
Figure 8:
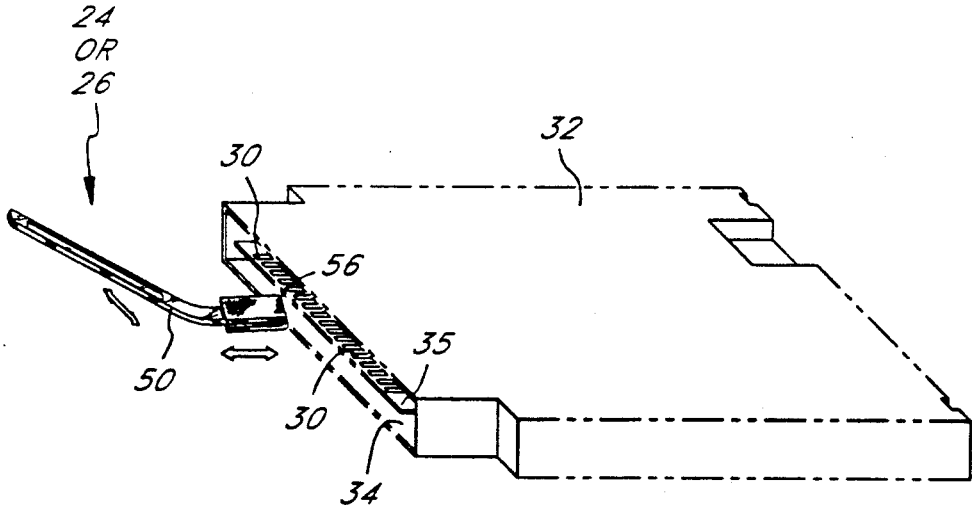
FIG. 8 is a perspective view of the preferred embodiment of the wand of the present invention with the video game cartridge shown in phantom.
Figure 9:
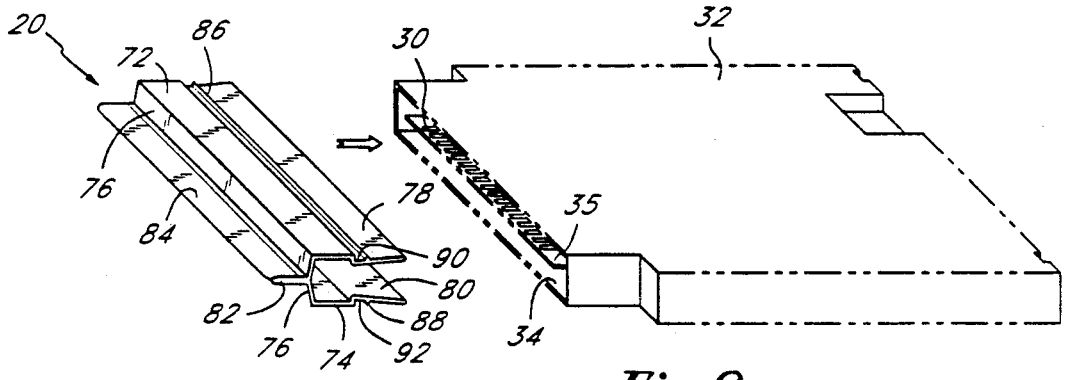
FIG. 9 is a perspective view of the preferred embodiment of the cleaning clip of the present invention with a video game cartridge shown in phantom.
Figure 11:
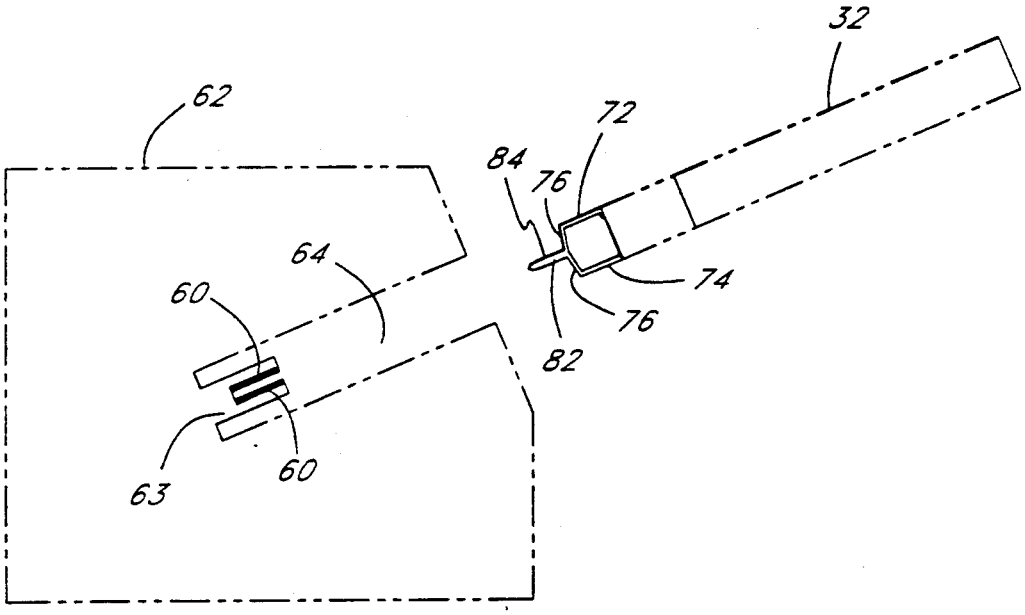
FIG. 11 is a side view of the cleaning clip of the present invention used with a video game cartridge and console shown in phantom.

A video game cartridge 32 has a series of contacts 30 that are coupled with a series of matching contacts 60 in a game console 62 to provide an electrical path between the cartridge 32 and the console 62. As illustrated in FIGS. 7-9, the contacts 30 of the game cartridge 32 are layers of a conducting material, like a metal alloy, and are mounted on the top and bottom of a circuit board 35. Typically, the circuit board 35 is a planar sheet made of insulating material housed within a rectangular cavity 34 in the game cartridge 32. The circuit board 35 is positioned parallel to the longitudinal walls of the cavity 34 at a substantially equal distance from each opposite wall. As shown in FIG. 11, the contacts 60 in the console 62 are also layers of a conducting material. These contacts 60 are located on a connecting pin 6-3 in a rectangular cavity 64 within the console 62 that is sized to fit the cartridge 32. The contacts 60 on the connecting pin 63 are designed to couple with the contacts 30 of the cartridge 32 when the circuit board 35 is inserted into the connecting pin 63.

The present invention is a system for cleaning the electrical contacts 30 and 60 of the game cartridge 32 and console 62. In a preferred embodiment, the present invention comprises a cleaning solution, a cleaning clip 20, a cleaning card 22, a cleaning wand 24 and a drying wand 26. The cleaning clip 20 is used primarily for cleaning the contacts 60 on the console 62 and the cleaning card 22 and wands 24 and 26 are used primarily to clean the contacts 30 on the cartridge 32. The cleaning solution is placed on the cleaning clip 20 or card 22, and then the cleaning clip 20 or card 22 is used to remove dirt and other debris from the contacts 30 and 60 inside the game console 62 or cartridge 32. Similarly, cleaning solution is placed on the cleaning wand 24 for application to the contacts 30 for additional cleaning. After the cleaning solution has been applied, the contacts 30 are dried with the cleaning card 22 or the drying wand 26.

The circuit board 35, the contacts 30 and 60, the cartridge 32 and the console 62 can be damaged by cleaning solutions commonly used to clean electrical contacts such as benzene, thinner, alcohol or other such solvents. These solvents often disintegrate the substrate material upon which the contacts 30 and 60 are placed and also delaminate the contacts 30 from the circuit board 35. These solvents can also melt the cartridge 3--2 or the console 62. In a preferred embodiment the cleaning solution of the present invention advantageously does not include any of these solvents. The cleaning solution is a detergent and water mixture that will not damage the contacts 30 and 60., the circuit board 35 or the connecting pin 63. Moreover, the cleaning solution is not harmful to either the cartridge 32 or the console 62 and is safe for children to use. In an exemplary embodiment, the cleaning solution is a mixture of water and the commercially available detergent know as Amway® "Zoom." The cleaning solution advantageously loosens dirt, low voltage build up and other foreign substances for easy removal. The contacts 30 are then cleaned by simply wiping the contacts 30 with the cleaning card 22 or wand 24. The contacts 60 on the console 62 are similarly cleaned by brushing the contacts 60 with the cleaning clip 20 or a power-up cleaning card for systems.

Figure 1:
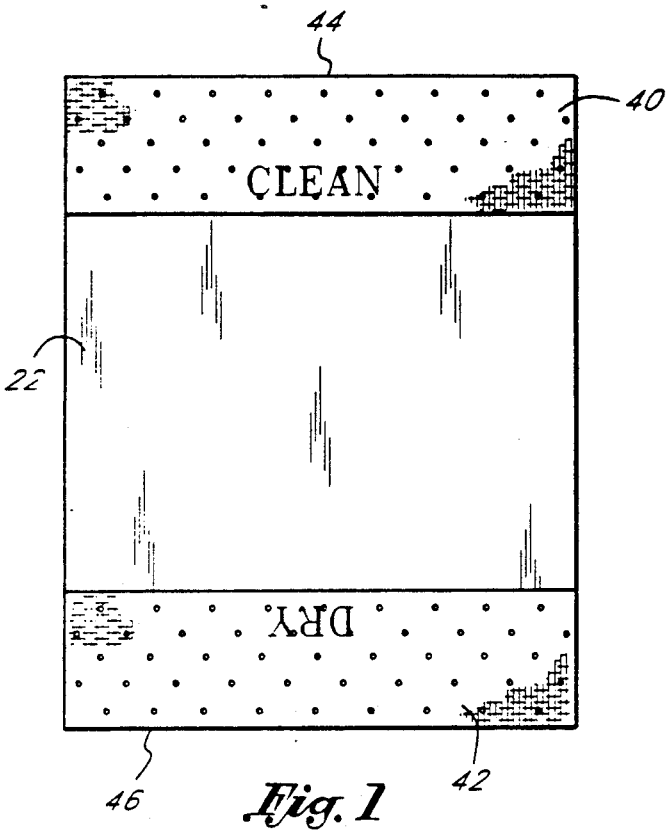
FIG. 1 illustrates a top plan view of a preferred embodiment of the cleaning card of the present invention.
Figure 2:
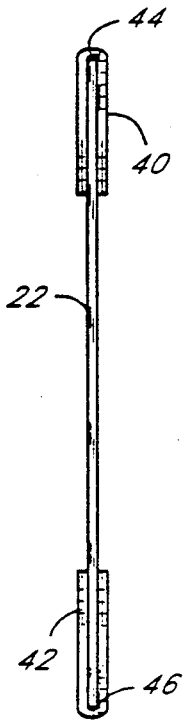
FIG. 2 illustrates a side view of the cleaning card of the present invention.
Figure 3:
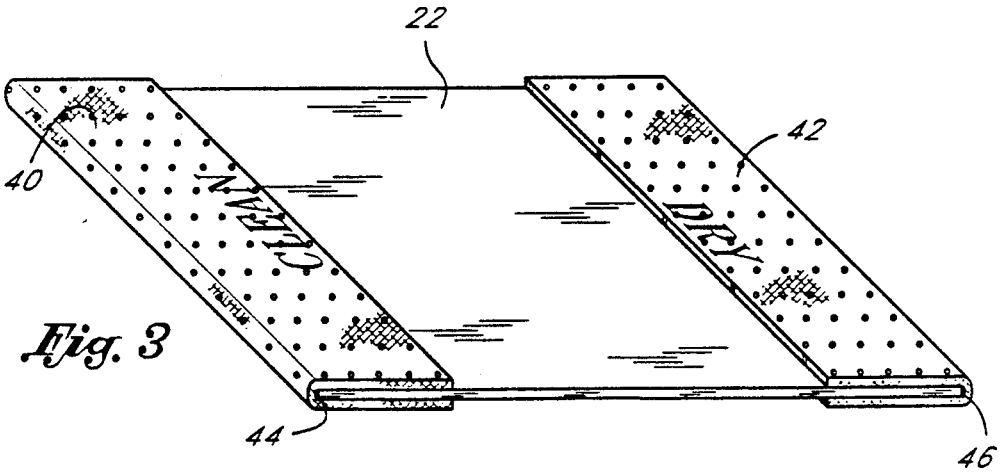
FIG. 3 illustrates a perspective view of the cleaning card of the present invention.

Referring now to FIGS. 1-3, a preferred embodiment of the cleaning card 22 as a substantially rectangular planar sheet is shown. In an exemplary embodiment, the cleaning card 22 has a length of 4.25 inches, a width of 3.25 inches, and a thickness of 0.06 inches. The size of the cleaning card 22 provides structural rigidity and length so that the cleaning card 22 may inserted into the cavity 34 of the game cartridge 32 to clean the contacts 30 using one hand. The width of the cleaning card 22 is advantageously about an inch less than the width of the cavity 34 in the game cartridge 32. This allows the cleaning card 22 to brush the contacts 30 in several directions. In particular, this width allows the cleaning card 22 to be moved sideways, as well as in and out to rub against the contacts 30 and 60 and clean them. Also, the cleaning card 22 may be made with various widths for different video games or systems. In an exemplary embodiment, the cleaning card 22 is made of plastic, but it should be understood that one skilled in the art could use other materials to construct the cleaning card 22.

The cleaning card 22 also has two pieces of porous fabric 40 and 42 attached at opposite ends 44 and 46 of the cleaning card 22. In a preferred embodiment, the first piece of porous fabric 40 is attached on the first end 44 and is used to apply the cleaning solution to the contacts 30. The second piece of porous fabric 42 is attached on the opposite end 46 and is used to dry the contacts 30. While the preferred embodiment of the cleaning card 22 has fabric 40 and 42 on each end 44 and 46, it should be understood that the cleaning card 22 could be constructed with only one end 4-4 adapted to fit the cartridge 32 and only one piece of fabric 40 attached thereon for applying the cleaning solution and cleaning the contacts 30. The contacts 30 would then be dried by letting any remaining cleaning solution evaporate. Each piece of porous fabric 40 and 42 provides a large cleaning surface area by covering a portion of the top and bottom of the cleaning card 22 in addition to covering the edges of each end 44 and 46, as illustrated in FIGS. 2 and 3. Also, the porous fabric 40 and 42 on the top and bottom of the card 22 advantageously eliminates the need to turn the cleaning card 22 over to clean the contacts 30 which are located on the top and bottom of the circuit board 35 in the cartridge 32. Although not shown, the ends 44 and 46 may also take a U-shape adapted to clean the contacts 30 on the top and bottom of the circuit board 35 simultaneously. In an exemplary embodiment, the porous fabric 40 and 42 covers the entire length of the edges including an area extending approximately 0.75 inches inward from each end 44 and 46. In a preferred embodiment, the porous fabric 40 and 42 is an absorbent, pliant material able to hold the cleaning solution. For consistent use of each end 44 and 46, the pieces of porous fabric 40 and 42 may be marked to describe their function as shown in FIGS. 1 and 3.

Another embodiment for the cleaning card 22 is a power up cleaning card (not shown). The power up cleaning cards are adapted to be inserted in to the game console 62 of various different game systems such as Atari®, Sega® and Commodore®. In an exemplary embodiment, such a power up cleaning card is planar and rectangular in shape. The power up cleaning card differs from the normal cleaning card 22 in two respects. First, the power up cleaning cards have material attached only upon one end. Second, the material used to cover the operational end is not porous fabric 40. In an exemplary embodiment, a 3 M® lapping film that has a very fine abrasive surface- is placed on the end of the power up cleaning card instead of porous fabric 40. The use of this type of material advantageously avoids any possibility of the material getting caught on the contacts 60 of the game console 62. The lapping film covers the edge and a portion of both sides of the power up cleaning card similar to the porous fabric 40. Thus, the contacts 60 on both interior sides of the connecting pin 63 are cleaned simultaneously.

The cleaning solution and the cleaning card 22 are used together, as shown in FIG. 7, to remove dirt and low voltage build up on the contacts 30 of the game cartridge 32. The cleaning solution is first placed on the porous fabric 40 labeled "CLEAN." The end 44 labeled "CLEAN" is then inserted into the cavity 34 of the game cartridge 32. The cleaning card 22 is positioned so that the porous fabric 40 touches the electrical contacts 30 of the game cartridge 32. The cleaning card 22 is moved in, out and sideways to apply the cleaning solution as the porous fabric 40 brushes across the contacts 30. Once the cleaning solution has been applied, the drying end 46 is positioned with the dry porous fabric 42 touching the contacts 30. The drying end 46 is then moved across the contacts 30 to absorb any cleaning solution and to remove any remaining dirt. While the cleaning card 22 is only shown and described cleaning the contacts 30 of the game cartridge 32, it should be understood that the alternate embodiment of the cleaning card 22 as a power up cleaning card may be inserted into the connecting pin 63 in the cavity 64 in a similar manner as just described to clean the contacts 60 of the console 62.

Figure 4:
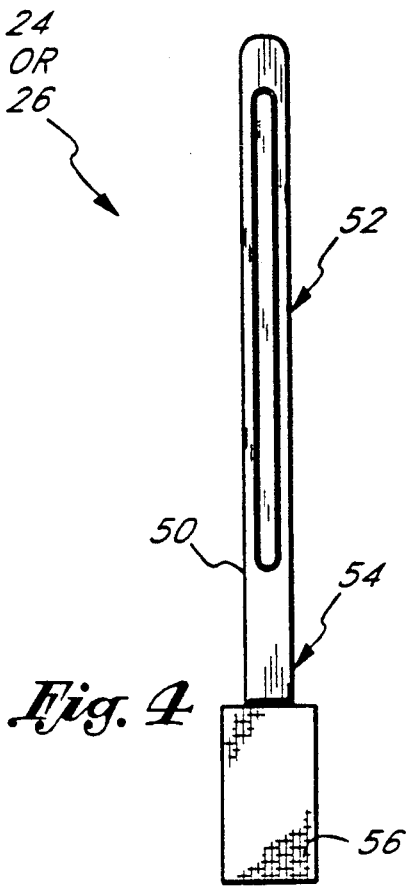
FIG. 4 illustrates a top plan view of a preferred embodiment of the wand of the present invention.
Figure 5:
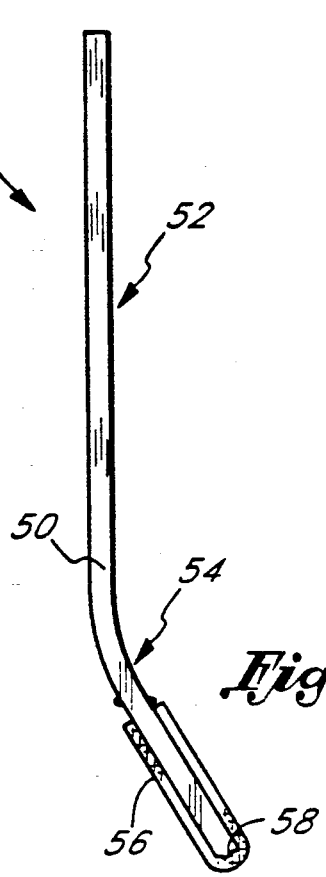
FIG. 5 illustrates a side view of the wand of the present invention.
Figure 6:
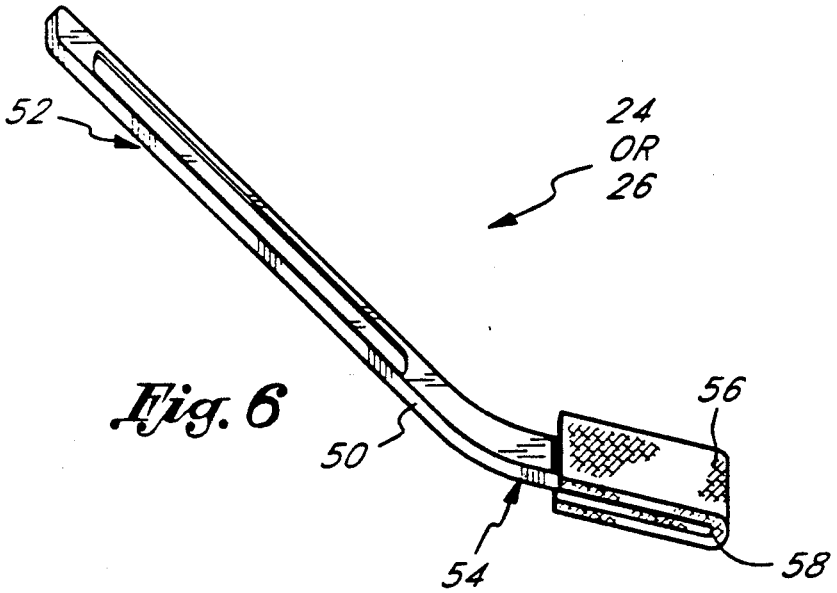
FIG. 6 illustrates a perspective view of the wand of the present invention.

Referring now to FIGS. 4–6, a preferred embodiment of the wands 24 and 26 of the present invention is illustrated. The cleaning wand 24 and the drying wand 26 may be virtually identical in structure since the only difference arises from the way each wand 24 and 26 is used. In a preferred embodiment, each wand 24 and 26 is comprised of a substantially rectangular oblong member 50 and a fabric cover 56. In an exemplary embodiment, the oblong member 50 has a length of 5.0 inches, a width of 0.25 inches and a thickness of 0.12 inches. Alternatively, the oblong member 50 may be a rod of appropriate length and diameter. The oblong member 50 is angularly bent at an obtuse angle, as seen in FIG. 5, to form a handle portion 52 and an end portion 54. This configuration makes the wands 24 and 26 much easier to use. The handle portion 52 of the oblong member 50 provides an area for the user to grasp each wand 24 and 26. The fabric cover 56 is a porous absorbent material such as chamois or sponge that is secured about the tip 58 of the oblong member 50. The fabric cover 56 covers a majority of the top and bottom of the end portion 54.

The cleaning wand 24 and drying wand 26 are used together to clean the game cartridge 32. In a preferred embodiment, the wands 24 and 26 are used to clean the area of the contacts 30 that are not cleaned by the cleaning card 22. However, it should be understood that the wands 24 and 26 could be used alone to clean the contacts 30. The wands 24 and 26 can access hard to reach areas because of their smaller dimensions. As illustrated in FIG. 8, the end portion 54 of each wand 24 and 26 can be moved into the cavity 34 in the game cartridge 32 to clean the contacts 30. The cleaning wand 24 has a function similar to that of the cleaning end 44 of the cleaning card 22. The cleaning solution is placed on the fabric cover 56 of the end portion 58 of the cleaning wand 24. Then the user manipulates the cleaning wand 24 so that the fabric cover 56 touches the contacts 30 or 60. The fabric cover 56 is rubbed across the contacts 30 or 60 to apply the cleaning solution, and remove any low voltage build up and dirt. Once the cleaning solution has been applied the drying wand 26 is used in a similar manner to dry the contacts 30 or 60 and remove any remaining dirt.

Figure 10:
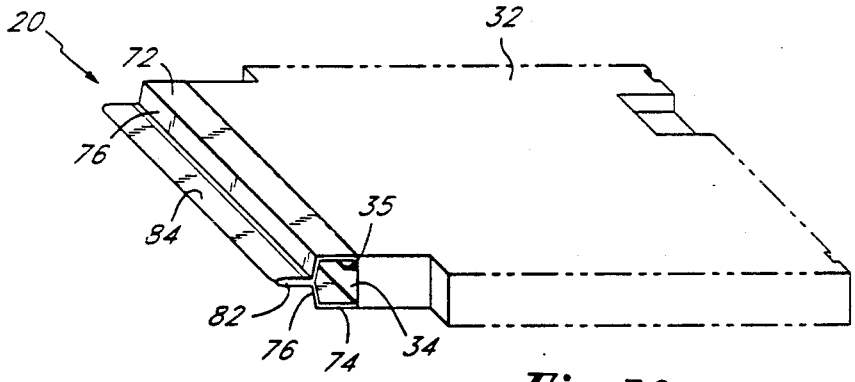
FIG. 10 is a perspective view of the cleaning clip of the present invention attached on a video game cartridge shown in phantom.

As illustrated in FIGS. 9–11, the cleaning clip 20 may also be used to clean the contacts 60 of the console 62. The cleaning clip 20 comprises a top wall 72, a bottom wall 74, and a side wall 76 integrally connected together to form a C-shaped member. The top wall 72 and bottom wall 74 are parallel and interconnected by the substantially perpendicular side wall 76. Preferably, the cleaning clip 20 is sized for attachment in the cavity 34 in the video game cartridge 32. In an exemplary embodiment, the walls 72, 74 and 76 have about the same dimensions and are 0.625 inches wide, 4.0 inches long and 0.0625 inches thick for use with a Nintendo ® game cartridge. A pair of flanges 78 and 80 are integrally connected to the top and bottom walls 72 and 74 respectively. The flanges 78 and 80 have about the same thickness and length as the walls 72 and 74. The upper flange 78 is attached on the distal end of the top wall 72. The upper flange 78 extends away from the side wall 76 and slightly upward. On the top of the upper flange 78 there is a protrusion 86 than extends longitudinally parallel to the edge of the top wall 72. The lower flange 80 is attached on the distal end of the bottom wall 74. The lower flange 80 extends away from the side wall 76, but slightly downward. There is also a protrusion 88 on the bottom of the lower flange 80 that extends longitudinally across the length of the flange 80. Advantageously, the flanges 78 and 80 and their protrusions 86 and 88 demountably attach the cleaning clip 20 and the cartridge 32 together. The protrusions 86 and 88 define slots 90 and 92 respectively, on the flanges 78 and 80 in which the cartridge 32 fits. Additionally, the cartridge 32 is secured inside the slots 90 and 92 by the force of the top and bottom walls 72 and 74 against the cavity 34. The top wall 72 and bottom wall 74 are forced against the cavity 34 because the walls 72 and 74 resist being compressed as required to insert the clip 20 into cartridge 32. The outward force is also slightly increased because the flanges 78 and 80 extend slightly outward away from each other.

The cleaning clip 20 further comprises a cleaning card in the form of a thin, flat, stiff blade 82 and an applicator strip 84 to apply the cleaning solution to the contacts 60 on the connecting pin 63 of the console 62. The blade 82 is a planar strip integrally connected to the side wall 76. The blade 82 is connected along the longitudinal axis of the side wall 76 approximately half way between the top and bottom of the side wall 76. The blade 82 is perpendicular to the side wall 76 and extends away from the top and bottom walls 72 and 74. The applicator strip 84 is mounted over a majority of both sides of the blade 82. The applicator strip 84 is advantageously made of the same material as that on the end of the power up cleaning card. In an exemplary embodiment, the applicator strip 84 is 3M ® lapping film that has a very fine abrasive surface for brushing the contacts 60.

In a preferred embodiment, the cleaning clip 20 is formed of molded plastic. The top wall 72, bottom wall 74, side wall 76, upper flange 78, lower flange 80 and blade 82 are integrally formed from a single piece of plastic. This is advantageous since molded plastic has the rigidity required for insertion of the blade 82 into the connecting pin 63 while also having the flexibility and resistance so that the flanges 78 and 80 may be compressed toward each other for insertion into the cartridge 32. It should be noted that the cleaning clip 20 may be constructed of other materials that have sufficient rigidity and flexibility.

To clean the contacts 60 of the game console 62, the cleaning clip 20 is attached to the video game cartridge 32 in the cavity 34 as shown in FIG. 10. The top wall 72 and the bottom wall 74 are pressed together which reduces the distance between the flanges 78 and 80 allows them to be inserted into the cavity 34 on the cartridge 32. The cleaning clip 20 is pushed into the cartridge 32 until the flanges 78 and 80 are inside the cavity 34 and the protrusions 86 and 88 lock the walls of the cartridge 32 into the slots 90 and 92. The clip 20 snaps into the locked position with the cartridge 32 abutting the top and bottom walls 72 and 74. Next, cleaning solution is placed on the applicator strip 84 and the cartridge 32 is inserted into the video console 62 as if the cartridge 32 were going to be used as in FIG. 11. The cartridge 32 and the cleaning clip 20 are repeatedly moved in and out of the connecting pin 63 of the console 62 causing the cleaning clip 20 to rub against the contacts 60 and olean them. The clip 20 may be removed in the same way it was inserted by pressing the top and bottom walls 72 and 74 together to disengage the cartridge 32 from the slots 90 and 92 on the flanges 78 and 80. Then the clip 20 may be pulled out of the cavity 34. Thus, the cleaning clip 20 provides an effective and efficient way to clean the contacts 60 of the console 62.

Having described the present invention in connection with certain preferred embodiments thereof, it will be understood that many modifications and variations thereto are possible, all of which fall within the true spirit and scope of this invention.

What is claimed is:

1. A device for cleaning the contacts of a video game cartridge for use in a video game system, comprising:

a cleaning component having a first planar end to clean said contacts, and a second planar end to dry said contacts;

a first section of material attached on said first end for receiving a cleaning solution and cleaning said contacts; and a second section of material, separate from said first section of material, attached on said second end for drying said contacts, wherein said first and said second sections of material are separated by a portion of the cleaning component.

2. The kit of claim 1, wherein said cleaning solution is substantially free from alcohol, benzene and thinner.

3. The cleaning device of claim 1, wherein said first and said second ends of said cleaning component are opposite ends sized to fit within a cavity in a video game cartridge that contains said contacts.

4. The cleaning device of claim 1, wherein said first section of material covers the edge of said first planar end and a portion of the top and bottom of said cleaning component proximate said first planar end, and wherein said second section of material covers the edge of said second planar end and a portion of said top and bottom of said cleaning component proximate said second planar end.

5. The cleaning device of claim 1, wherein said sections of material are absorbent, pliant and durable cloth to retain, apply and remove said cleaning solution.

6. A device for cleaning electrical contacts of a video game system, comprising:

a card having a thin, flat, stiff cleaning end and a thin, flat, stiff drying end, said cleaning and said drying ends sized to be positioned adjacent to a plurality of said contacts;

a first section of material attached to said cleaning end and adapted to engage and apply cleaning solution to said contacts; and a second section of material attached to said drying end and adapted to engage and dry said contacts, wherein said first and said second sections of material are separated by a portion of said card so as to inhibit the cleaning solution on the first section of material from contacting the second section of material.

7. The device of claim 6, wherein said first section of material covers the edge of said cleaning end and a portion of the top and bottom of said card proximate said cleaning end; and wherein said second section of material covers the edge of said drying end and a portion of the top and bottom of said card proximate said drying end.

8. The device of claim 6, wherein said sections of material are absorbent, pliant and durable cloth to retain, apply and remove said cleaning solution.

9. An apparatus for cleaning the contacts of a video game system, comprising:

a planar card having a first end and a second end;

a first section of material attached on said first end for receiving a cleaning solution and cleaning said contacts; and a second section of material attached on said second end for drying said contacts, wherein said first section of material and second section of material are separated by at least a portion of the planar card so as to minimize the transfer of cleaning solution from said first section of material to the second section of material.

10. The cleaning device of claim 9, wherein said first and said second ends of said planar card are opposite ends sized to fit within a cavity in a video game cartridge that contains said contacts.

11. The cleaning device of claim 9, wherein said first section of material covers the edge of said first end and a portion of the top and bottom of said planar card proximate said first end, and wherein said second section of material covers the edge of said second end and a portion of the top and bottom of said planar card proximate said second end.

* * * * *